US010104951B2

(12) United States Patent
Lee

(10) Patent No.: US 10,104,951 B2
(45) Date of Patent: Oct. 23, 2018

(54) COMPACT CONTAINER HAVING FUNCTION OF UNIFORMLY DISCHARGING COSMETIC SOLUTION

(71) Applicants: PUM-TECH KOREA CO., LTD., Incheon (KR); F.S KOREA INDUSTRIES INC, Seoul (KR)

(72) Inventor: Do Hoon Lee, Incheon (KR)

(73) Assignees: PUM-TECH KOREA CO., LTD., Incheon (KR); F.S. KOREA INDUSTRIES INC., Seoul (KR)

( * ) Notice: Subject to any disclaimer, the term of this patent is extended or adjusted under 35 U.S.C. 154(b) by 520 days.

(21) Appl. No.: 14/786,485

(22) PCT Filed: May 15, 2014

(86) PCT No.: PCT/KR2014/004351
§ 371 (c)(1),
(2) Date: Oct. 22, 2015

(87) PCT Pub. No.: WO2014/185722
PCT Pub. Date: Nov. 20, 2014

(65) Prior Publication Data

US 2016/0073761 A1 Mar. 17, 2016

(51) Int. Cl.
*A45D 33/02* (2006.01)
*A45D 33/00* (2006.01)
(Continued)

(52) U.S. Cl.
CPC ..... *A45D 33/02* (2013.01); *A45D 33/006* (2013.01); *A45D 33/025* (2013.01); *A45D 33/04* (2013.01);
(Continued)

(58) Field of Classification Search
CPC .. A45D 33/003; A45D 33/006; A45D 33/008; A45D 33/0025; A45D 33/04; A45D 33/06; A45D 33/16; A45D 33/18
(Continued)

(56) References Cited

U.S. PATENT DOCUMENTS

2009/0272400 A1* 11/2009 Park et al. ..... A45D 33/02 132/298
2014/0001210 A1* 1/2014 Lim ..... A45D 34/00 222/162

FOREIGN PATENT DOCUMENTS

KR 20-0370246 Y1 12/2004
KR 20-0372911 Y1 1/2005
(Continued)

*Primary Examiner* — Cris L Rodriguez
*Assistant Examiner* — Brianne Kalach
(74) *Attorney, Agent, or Firm* — Heedong Chae; Lucem, PC

(57) ABSTRACT

A compact container having a function of uniformly discharging a cosmetic solution, which selectively discharges the contents out of the compact container using employing a push-type button and uniformly discharges the cosmetic solution by employing a disk-type panel having micro-holes. The compact container includes a container body (11), a fixing structure (15) securely counted in the container body to define the first storage space and having a structure hole, a first case (25) mounted on the container body to cover the fixing structure and having a discharge port to discharge the contents from the container body, a disk-type panel (57) counted on the first case and having a plurality of micro-holes to guide the contents provided through the discharge port such that the contents are discharged upward in a diffused form, a piston module (43) located in the structure hole to move between upper and lower portions of the structure hole and to open/close the discharge port, a push button (47) interposed between the firing structure and a
(Continued)

protective case and performing a push operation to move the piston module between the upper and lower portions of the structure hole, and a content compressing unit (41) mounted on an inner wall of the fixing structure to move the contents, which are stored in the first storage space, into the structure hole by the operation of the push button.

10 Claims, 9 Drawing Sheets

(51) Int. Cl.
*A45D 33/04* (2006.01)
*A45D 33/06* (2006.01)
*A45D 40/00* (2006.01)

(52) U.S. Cl.
CPC ..... *A45D 33/06* (2013.01); *A45D 40/0075* (2013.01); *A45D 2200/055* (2013.01)

(58) Field of Classification Search
USPC ..... 222/405, 256, 385, 525
See application file for complete search history.

(56) References Cited

FOREIGN PATENT DOCUMENTS

| | | | |
|---|---|---|---|
| KR | 20-0390095 | Y1 | 7/2005 |
| KR | 20-0461424 | Y1 | 7/2012 |
| WO | WO 2006-033559 | A1 | 3/2006 |

* cited by examiner

COMPACT CONTAINER HAVING FUNCTION OF UNIFORMLY DISCHARGING COSMETIC SOLUTION

TECHNICAL FIELD

The present invention relates to a compact container having a function or uniformly discharging a cosmetic solution. More particularly, the present invention relates to a compact container having a function of uniformly discharging a cosmetic solution, capable of selectively discharging contents out of the compact container employing a push-type button, and capable of uniformly discharging the cosmetic solution by employing a disk-type panel having micro-holes.

BACKGROUND ART

In general, a user puts on color makeup using various color cosmetics after basically applying skin or lotion having a moisturizing function to the face of the user in order to protect the facial skin of the user.

Color cosmetics used in the color makeup described above are appropriately required to be used according to makeup parts, and include various colors of products. Accordingly, when a user carries with color cosmetics while going out, the user must carry with many color cosmetics, thereby increasing the volume of cosmetics to be carried.

In order to reduce the volume of the color cosmetics described above, most consumers carry with cosmetic samples. In match with this, cosmetic samples are provided.

Meanwhile, regarding a conventional cosmetic case, which has hear extensively used, the cosmetic case is disclosed in Korean Patent Registration No. 10-1190041. As shown in FIG. 1, the cosmetic case includes a cosmetic receiving part 10, a cover member 20, and a mirror 30. The mirror 30 is attached no the bottom surface of the cover member 20. The cover member 20 is coupled to the cosmetic receiving part 10 and locked to the cosmetic receiving part 10 by a locking unit 12. The cosmetic case is configured to allow a user to open the cover member 20 by pressing a locking releasing unit 11 and to make up while looking at the mirror 30.

In the conventional compact container, the body is coupled to an overcap by a coupling member having a ring shape. In the state that the overcap is closed, the body is pivotally coupled to the overcap through a screw, so that the internal air tightness or the compact container is improved to some extent.

However, since the conventional compact container makes it difficult for a user to use a uniform amount of contents, the user uses an excessively large amount or compact powders or a small amount of compact powders, so that the user cannot maximize a makeup effect. In addition, the conventional compact container may not prevent contents from being chemically changed or prevent the peripheral portion of the compact container from being contaminated when the overcap is artificially open and stored, or open due to the carelessness of the user.

DISCLOSURE

Technical Problem

The present invention is made in order to solve the above problems, and an object of the present invention is to provide a compact container enabling a user to more easily use a cosmetic solution as contents are selectively discharged out of the compact container by mounting a push-type button in the compact container while the cosmetic solution is uniformly pumped through the entire portion of the disk panel having a plurality of holes.

In addition, another object of the present invention is to provide a compact container having an airless pump, capable of maximizing a makeup effect as a uniform amount of contents is discharged by using the push-type button.

Technical Solution

In order to accomplish the above objects, there is provided a compact container having a function of uniformly discharging a cosmetic solution. The compact container includes a container body (11) having a first storage space to store contents therein, a fixing structure (15) securely mounted in the container body to define the first storage space and having a structure hole, a first case (25) mounted on the container body to cover the fixing structure and having a discharge port to discharge the contents from the container body, a disk-type panel (57) mounted on the first case and having a plurality of micro-holes to guide the contents provided through the discharge port such that the contents are discharged upward in a diffused form, a piston module (43) located in the structure hole to move between upper and lower portions of the structure hole and to open/close the discharge port, a push button (47) interposed between the fixing structure and a protective case and performing a push operation to move up and down the piston module from the upper portion to the lower portion of the structure hole, a content compressing unit (41) mounted on an inner wall of the fixing structure to move the contents, which are stored in the first storage space, into the structure hole by the operation of the push button, and a valve module (77) to open/close the fixing structure in the first storage space by an operation of the content compressing unit and to communicate the structure hole with the first storage space.

In addition, the push button (47) and the piston module (43) move in directions perpendicular to each other.

The push button (47) includes a first pressing unit (73) including a pressing protrusion (73*a*), and a first horizontal panel (73*b*) extending from both sides of the pressing protrusion, the first horizontal panel being formed therein with an insertion hole (73*c*) having a semi-circular shape and hinge parts (73*d*) formed at both sides of the first horizontal panel (73*b*), and a second pressing unit (75) fitted into the insertion hole (73*c*) of the first pressing unit (73), and including a support protrusion (75*a*), and a second horizontal panel (75*b*) extending from both sides of the support protrusion, the second pressing unit (75) being coupled to the first horizontal panel through a hinge (75*c*), and the second horizontal panel (75*b*) is formed therein with a hole (75*d*) having a semi-circular shape.

Further, the piston module (43) includes a discharge port opening/closing unit (51) to open/close the discharge port through an opening/closing unit through hole formed in the push button, a sealing unit (53) moving up and down corresponding to up and down movement operations of the discharge port opening/closing unit, and a support member (55) pausing through the sealing unit and controlling discharge of the contents by making contact with or separating from an end or the sealing unit.

In addition, a sealing cover is additionally mounted on the disk-type panel, having a ring shape, and serving as a fixing unit.

In addition, a space part (57*b*) is interposed between the first case (25) and the disk-type panel (57) and the cosmetic solution provided through the discharge port (23) passes through the space part (57*b*).

In addition, the disk-type panel (57) is located on the piston module (43).

Further, the disk-type panel (57) includes metal or synthetic resin.

Advantageous Effects

As described above, according to the compact container having the airless pump of the present invention, the contents can be selectively discharged out of the compact container by mounting the push-type button in the compact container while the cosmetic solution is uniformly pumped through the entire portion of the disk panel having a plurality of holes. Accordingly, the user can more easily use the cosmetic solution.

In addition, the present invention can provide the compact container having an airless pump, capable of maximizing a makeup effect as the uniform amount of contents is discharged by using the push-type button.

BEST MODE

Mode for Invention

Hereinafter, the operating principle according to an exemplary embodiment of the present invention will be described in detail with reference to accompanying drawings and the following description. In this case, the accompanying drawings and the following description are provided in the exemplary way among various ways to effectively explain the features of the present invention, and the present invention is not limited to the accompanying drawings and the following description.

In the following description of the embodiments of the present invention, if it is determined that description about well-known functions or configurations may make the subject matter of the embodiments unclear, the details thereof will be omitted. Terminologies used in this specification are selected from general terminologies by taking the functions thereof into consideration and they may vary depending on the intents of a user or an operator or precedents thereof. Accordingly, the terminologies used in this specification should be defined based on the substantial meanings thereof and the whole context throughout the present specification.

For the effective following description of technical elements according to an exemplary embodiment of the present invention, the details of elements previously provided in each system configuration or the details of the system configuration generally provided in an art to which the present invention pertains are omitted, and the following description will be made while focusing on the functional configuration to be additionally provided for the present invention.

Those killed in the art can easily understand the functions of elements, which have been conventionally used. In addition, those skilled in the art can easily understand the functions of elements, which have been already used in the related art, among functional elements which are not shown and omitted in the following description. In addition, those skilled in the art can apparently understand the relationship between the omitted elements and elements added to the present invention.

In addition, in the following description, the terminology is appropriately modified and used in order to effectively explain the essential technical features of the present invention so that those skilled in the art can apparently understand the essential technical features of the present invention, but the present invention is not limited thereto.

As a result, the technical spirit of the present invention is determined by attached claims, and the following embodiment is provided in order to effectively explain the inventive step of the technical spirit of the present invention to those skilled in the art.

Figure 1:
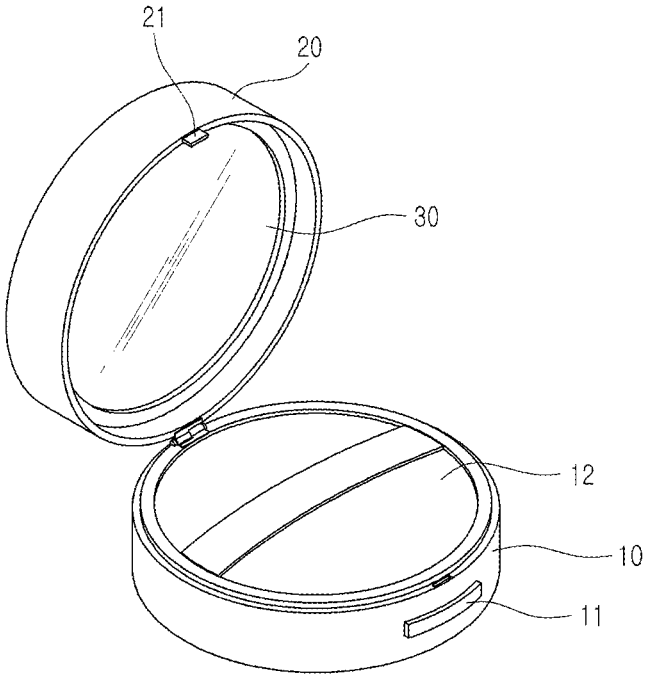
FIG. 1 is a perspective view showing an outer appearance of a conventional compact container.
Figure 2:
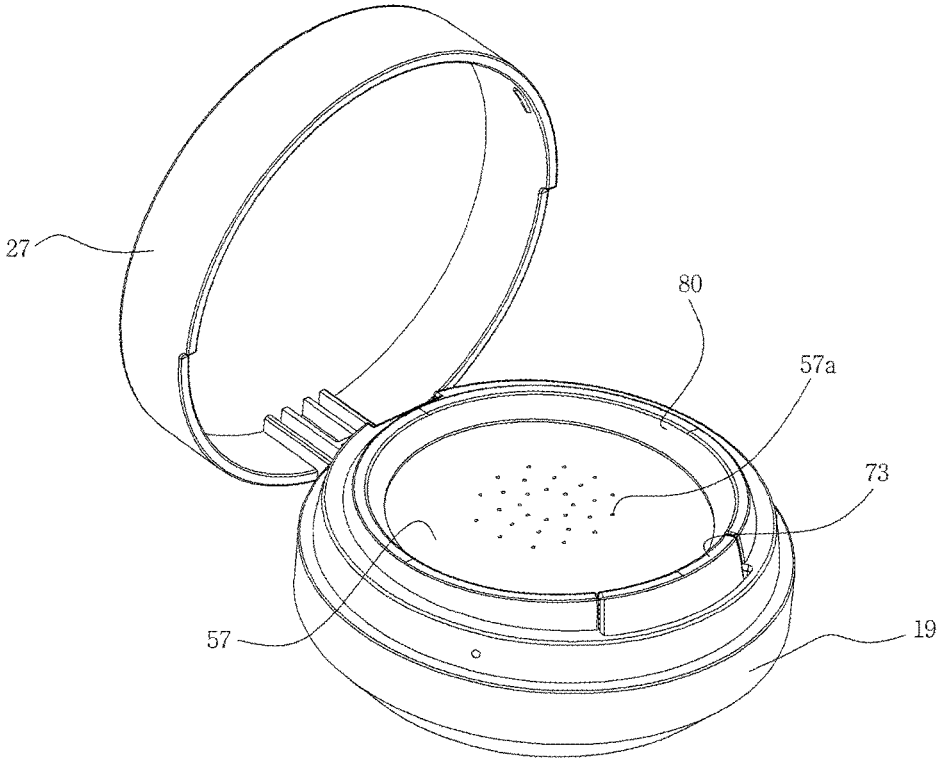
FIG. 2 is a perspective view showing a whole outer appearance of the compact container according to the present invention.

FIG. 2 is a perspective view shoving a whole outer appearance of a compact container according to the present invention.

Figure 3:
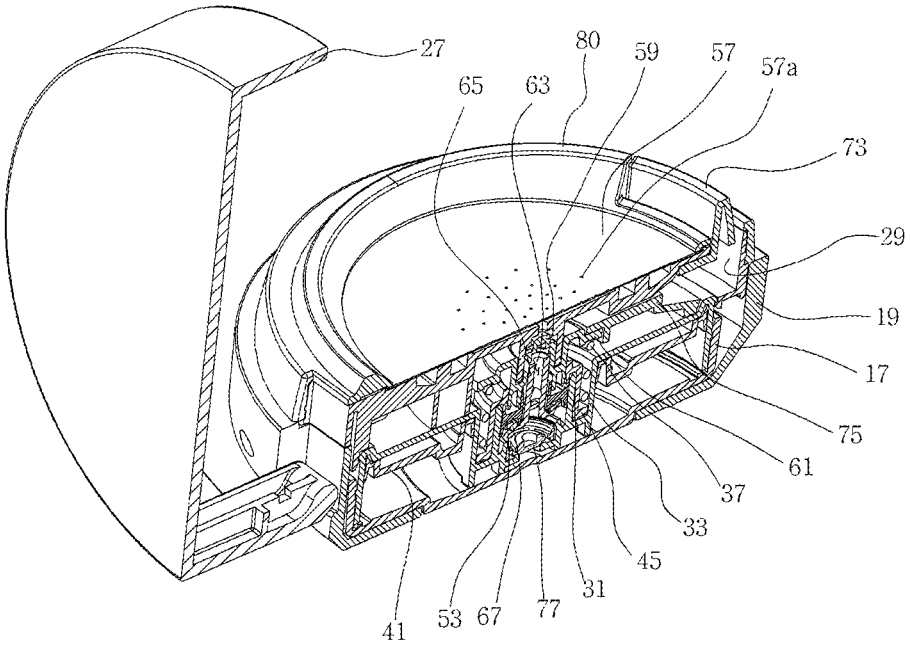
FIG. 3 is a partially cut perspective view showing the compact container according to the present invention.

FIG. 3 is a partially cut perspective view showing the compact container according to the present invention.

Figure 4:
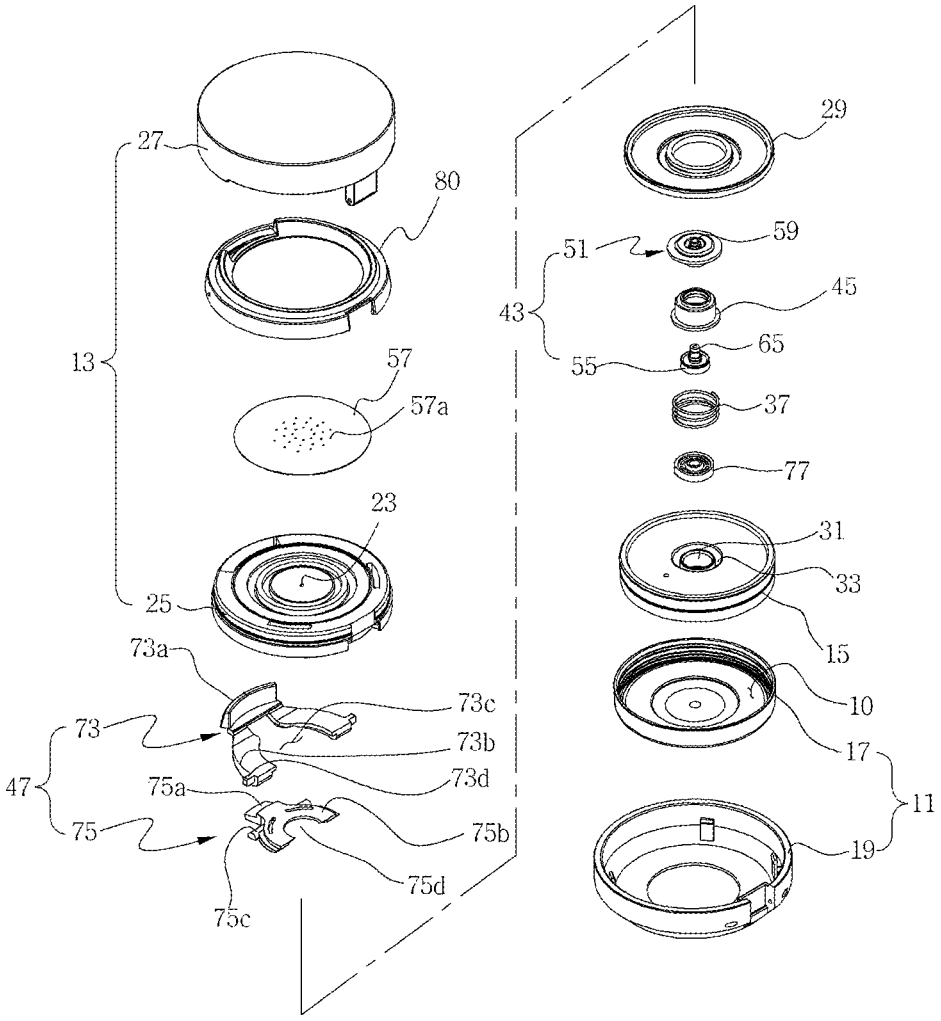
FIG. 4 is an exploded perspective view showing the compact container according to the present invention.

FIG. 4 is an exploded perspective view showing the compact container according to the present invention.

Figure 5:
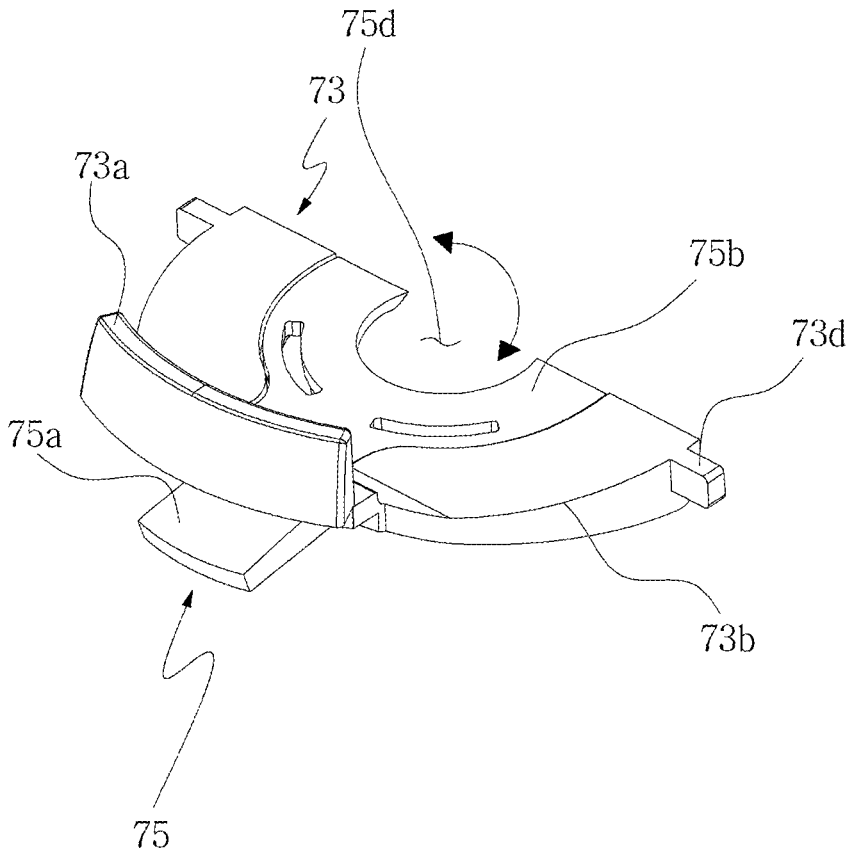
FIG. 5 is an exploded perspective view showing a push button according to the present invention.

FIG. 5 is an exploded perspective view showing a push button according to the present invention.

Figure 6:
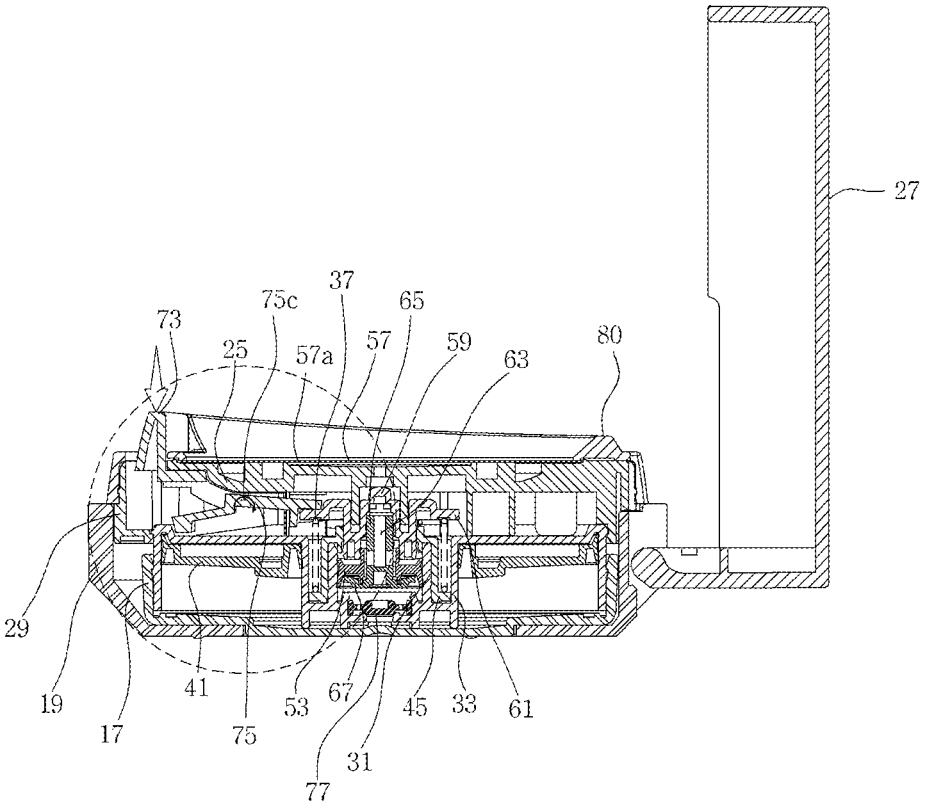
FIG. 6 is a sectional view according to the present invention.

FIG. 6 is a sectional view of the present invention.

Figure 7:
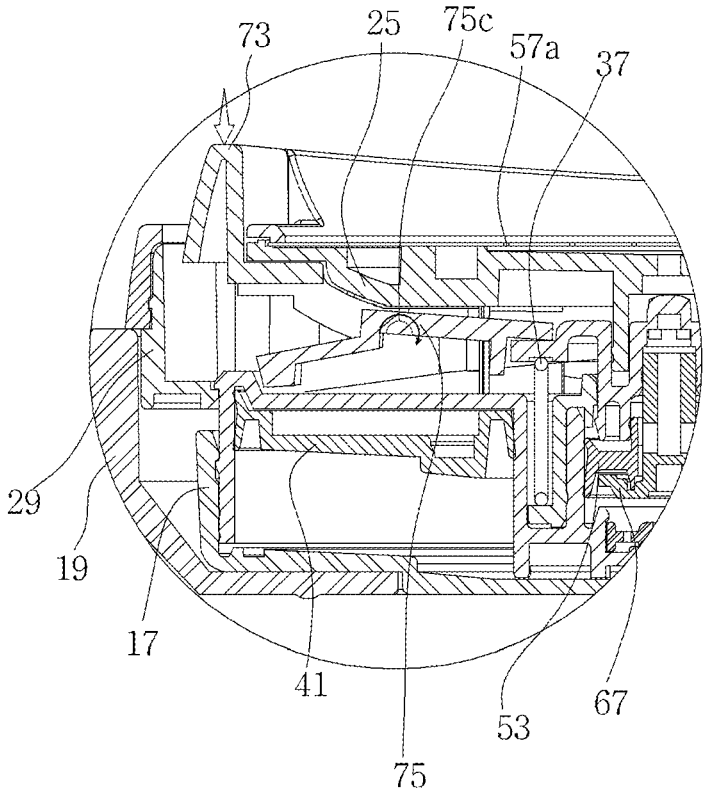
FIG. 7 is an enlarged view showing a subject matter of FIG. 6.

FIG. 7 is an enlarged view showing a subject matter of FIG. 6.

Figure 8:
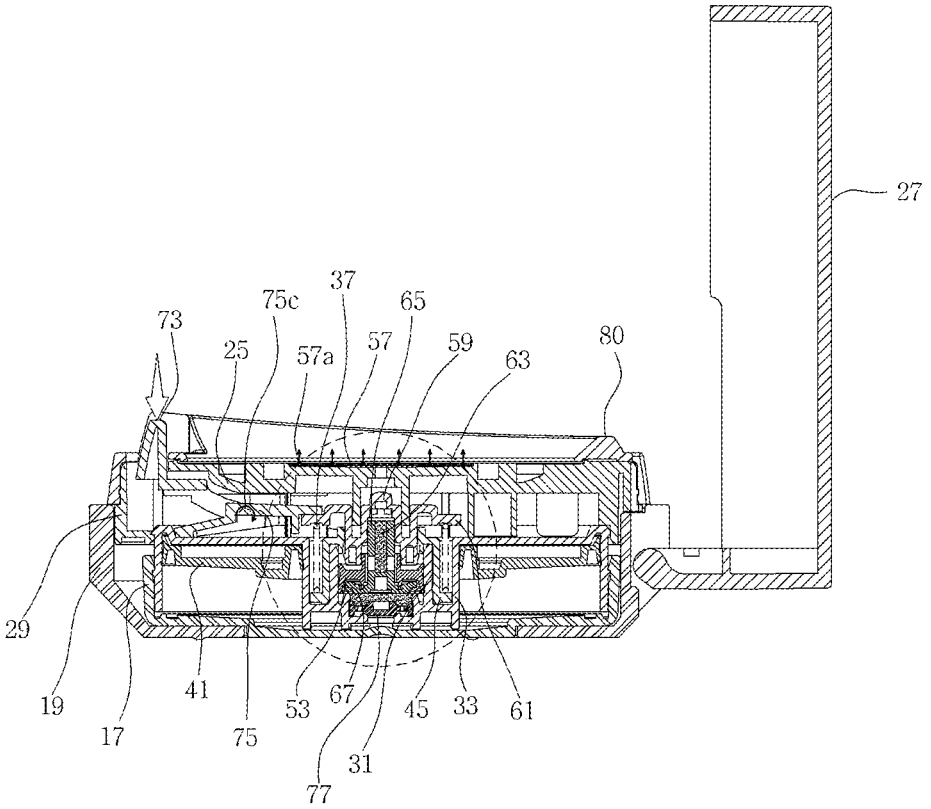
FIG. 8 is a sectional view showing the pumping operation according to the present invention.

FIG. 8 is a sectional view showing a pumping operation according to the present invention.

Figure 9:
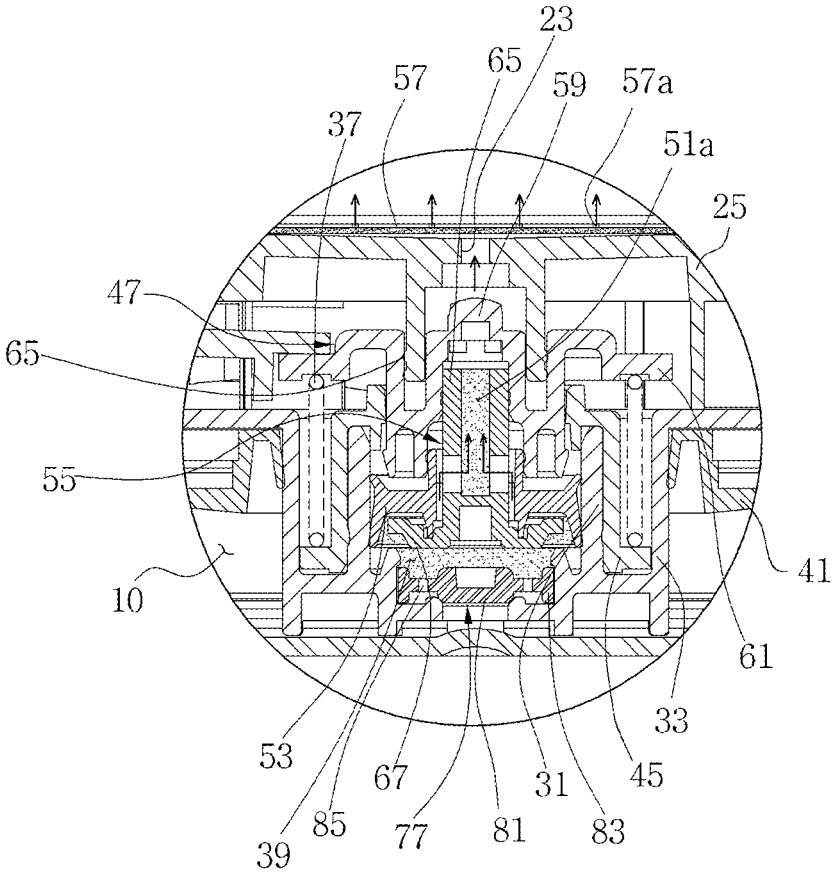
FIG. 9 is an enlarged view showing the subject matter of FIG. 8.

FIG. 9 is an enlarged view showing the subject master of FIG. 8.

A compact container 100 having an airless pump according to the embodiment of the present invention includes a container body 11 having a first storage space 10 to store contents therein and a protective case 13 mounted on the container body 11.

According to the embodiment of the present invention, although the compact contents have been described for the illustrative purpose, the contents may be cosmetic substances in the form of solidified powers, gel, or liquid, and may include skin contact materials stored in a container and applied to a skin.

The container body 11 includes a first body 17 coupled to a fixing structure 15 to define a first storage space 10 and a second body 19 to surround the first body 17. The second body 19 has a hinge-coupling structure so that the protective case 13 is rotatable. The coupling structure of the second body and the protective case are generally known to those skilled, so that the details thereof will be omitted.

The protective case 13 includes a first case 25 including a discharge port 13 to discharge contents stored in the first storage space 10 and a second case 27 formed on the first case 25 and hinged to the second body 19. Reference numeral 29, which is not described yet, represents a support unit to support between the first case and the second body.

The fixing structure 15 is interposed between the first case 25 and the first body 17. The fixing structure 15 is securely mounted in the container body 11 to define the first storage space 10 together with the first body 17. The fixing structure 15 includes a first cylinder 33 formed therein with a structure hole 31 and a second cylinder 35 spaced apart from the first cylinder 33 to surround the first cylinder 33. The second cylinder 35 extends from the top surface of the fixing structure 15 to the lower portion thereof.

In this case, the first cylinder 33 is preferably formed to interpose a first elastic unit 37 between the first cylinder 33 and the second cylinder 35. In this case, the first elastic unit 37 may be formed of a spring or elastic rubber. A second storage space 39 is formed under the structure hole 31 of the first cylinder to temporarily store contents before discharging the contents through a discharge port 23. A content compressing unit 41 is interposed between the fixing structure 15 and the first body 17.

The content compressing unit 41 is preferably located on the contents stored in the first storage space 10. The content compressing unit 41 moves to the lower portion of the first storage space 10 corresponding to the height of the contents lowered when the contents are discharged through the discharge port 23. The content compressing unit 41 is preferably mounted or the inner wall of the fixing structure 15 to move to the lower portion of the first storage space 10 along the surface of the second cylinder 35 through the second cylinder 35.

Meanwhile, a piston module 43 is located in the second storage space 39 inside the first cylinder of the fixing structure 15 to move between upper and lower portions of the structure hole 31 and to open/close the discharge portion 23, and a position limiting unit 45 is mounted on an upper end of the first cylinder 33. In addition, a push button 47 is interposed between the piston module 43 and the first case 25 to move up and down the piston module 43.

The push button 47 according to the present invention includes a first pressing unit 73 and a second pressing unit 75.

The first pressing unit 73 includes a pressing protrusion 73*a*, and a first horizontal panel 73*b* extending from both sides of the pressing protrusion, and the first horizontal panel 73*b* is formed therein with an insertion hole 73*c* having a semi-circular shape. Hinge parts 73*d* protrude from both sides of the first horizontal panel 73*b*.

The second pressing unit 75 is fitted into the insertion hole 73*c* of the first pressing unit 73, and includes a support protrusion 75*a*, and a second horizontal panel 75*b* extending from both sides of the support protrusion 75*a*. A hinge 75*c* is mounted to be coupled to the first horizontal panel, and the second horizontal panel 75*b* is formed therein with a hole 75*a* having a seed-circular shape.

The second horizontal panel 75*b* is coupled to the upper surface of a discharge port opening/closing unit 51 while surrounding the upper surface of the discharge port opening/closing unit 51. If the pressing protrusion 73*a* of the first pressing unit 73 is pressed, the second horizontal panel 75*b* of the second pressing unit 75 is moved to actuate the piston module 43.

The piston module 43 includes the discharge port opening/closing unit 51 to open/close the discharge port 23 of the first case 25, a sealing unit 53 located at the lower portion of the discharge port opening/closing unit 51 inside the first cylinder 33, and a support member 55 located at the lower portion of the sealing unit 53.

The discharge port opening/closing unit 31 opens/closes the discharge port 23 by passing through the opening/closing unit through hole 57 formed in the pushbutton 47. The discharge port opening/closing unit 51 includes an opening/closing rod 59 opening the discharge port 23 and having a guide passage 51*a* to guide the contents in a direction of the discharge port 23. In addition, the discharge port opening/closing unit 51 includes a flange part 61 extending from the opening/closing rod 59 to move up and down the opening/closing rod 53 through the operation of the step part 75 extending from the bottom surface of the push button 47.

The sealing unit 53 moves up and down corresponding to up end down movement operations of the discharge port opening/closing unit 51. The sealing unit 53 moves up and down along the inner wall of the first cylinder 33, and the up movement operation of the sealing unit 53 is limited by the position limiting unit 45 located at the upper end of the first cylinder 33. In other words, the position limiting unit 45 limits the maximum lifting height of the sealing unit 53.

The support member 55 is formed in a cylinder shape to pass through the sealing unit 53, and a guide hole to guide the contents. The guide hole includes a support body 65 and a support member extending part 67 extending from an end of the support body 65 to make contact with or separate from the end of the sealing unit 53. The support member extending part 57 controls the discharge of the contents by making contact with or separating from the end of the sealing unit 53. In other words, the support member 55 moves the contents stored in the second storage space 39 to the discharge port 23 by making contact with or separating from the end of the sealing unit 53.

A disk-type panel 57 formed therein with a micro-discharge hole 57*a* is coupled to an upper portion of the discharge port 23 and a cosmetic solution provided through the discharge port 23 is lifted upward of the disk-type panel 57 through a space part 57*b* and the micro-discharge hole 57*a*. Thereafter, the user can make up using the cosmetic solution lifted upward of the disk-type panel 57.

In other words, the disk-type panel 57 is adapted to be located on the piston module 43, and to output the cosmetic solution discharged upward by the pumping operation of the piston module out of the discharge port and the micro-discharge hole.

In addition, the disk-type panel 57 is made of metal or synthetic resin. Accordingly, in order to easily form the micro-discharge hole in the body of the panel 57 by boring the body of the panel, metal or synthetic resin is provided, and many micro-holes in the body. For reference, the hole may be variously bored in a flower or butterfly shape.

A sealing cover 80 having a ring shape is further mounted on the disk-type panel 57 to serve as a fixing unit. The sealing cover 57 covers an outer portion of the first case to fix the disk-type panel.

The push operation of the push button 47 located at the upper portion of the piston module 43 moves the piston module 43 between the upper and loner portions of the structure hole 31. In this case, the relative moving directions of the push button 47 and the piston module 43 are preferably perpendicular to each other.

Meanwhile, a valve body 77 is located at a lower portion of the second storage space under the support member 55. The valve module 77 includes a valve body 81 formed at a lower portion of the fixing structure 15 to open/close a communication hole 79 to communicate the first storage space 10 with the second storage space 39. In this case, the valve body 81 communicates the first storage space 10 with the second storage space 39 to control the movement of the contents from the first storage space 10 to the second storage space 39. A valve extension part 83 extends from the valve body 81 so that the valve extension part 83 is supported by the fixing structure 15. The valve extension part 83 includes a content introducing port 85 to move the contents stored in the first storage space 10 so the second storage space 39 when the storage space communication hole 79 is open.

Therefore, according to the compact container 100 of the present invention, the push button 47 is mounted at the upper portion of the discharge port opening/closing unit, and only a predetermined amount of contents are selectively discharged to the outside of the compact container 100, thereby preventing the contents stored in the container from being contaminated from foreign matters. Further, according to the compact container 100, the discharge port 23 is closed when the cosmetics are not used for a long time, thereby preventing the ratio between ingredients of the contents from being changed as moisture is vaporized from the contents. Accordingly, the contents in the optimal state may be used. When the cosmetics are not used, the discharge port 23 is closed to prevent the contents from leaking as the container is unintentionally pressed.

Hereinafter, the operation of the present invention will be described with reference to FIGS. 7 to 9.

The user exposes the first case 25 while opening the second case 27 in order to use the compact container 100. In this case, the discharge port 23 of the first case 25 is closed by the opening/closing rod 59 provided in the discharge port opening/closing unit 51. Therefore, according to the compact container 100 of the present invention, the discharge port 23 is closed when the cosmetics are not used for a long time, thereby preventing the ratio between ingredient a of the contents from being changed as moisture is vaporized from the contents, so that the contents in the optimal state may be used. In addition, when the cosmetics are not used, the discharge port 23 is closed to prevent the contents from leaking as the container is unintentionally pressed.

If the user presses down the pressing protrusion 73*a* of the first pressing unit 73 of the push button 47, the first horizontal panel 73*b* is moved down from the hinge part 73*d*.

In this case, the second pressing unit 75 coupled to the central portion of the first horizontal panel 73*b* through the hinge 75*c* is moved down, and the second horizontal panel 75*b* is pressed about the support protrusion 75*a* of the second pressing unit 75.

In other words, if the first pressing unit 73 is pressed, the second horizontal panel 75*b* of the second pressing unit 75 rotates the hinge 75*c* to move down.

In addition, if the second horizontal panel 75*b* is moved down, the discharge port opening/closing unit 51 making contact with the second horizontal panel 75*b* is pressed. In addition, the discharge port opening/closing unit 51 is moved to the lower portion of the second storage space 39 of the fixing structure 15.

As the discharge opening/closing unit 31 is moved down in the first cylinder 33 of the fixing structure 15, the sealing unit 53 and the support member 55 sequentially located under the discharge port opening/closing unit 51 are moved to the lower portion of the second storage space 35.

As the support member 55 is moved to the lower portion of the second storage space 33, the end of the sealing unit 53 and the support extension part 67 of the support member 55 in contact with each other are spaced apart from each other by the contents previously stored in the second storage space 39. Accordingly, the contents stored in the second storage space 39 are moved to the guide hole 63 of the support member 55 along the space between the end of the sealing unit 53 and the support extension part 67 of the support member 55, which are spaced apart from each other, and discharged out of the compact container 100 through the discharge port 23 of the first case 25.

In addition, according to the present invention, the disk-type panel 57 is additionally mounted on the discharge port 23, and the micro-holes 57*a* are formed in the disk-type panel 57, so that the cosmetic solution output through the discharge port 23 is output through the micro-holes 57*a*. Accordingly, the cosmetic solution is uniformly discharged to the upper portion of the disk-type panel 57, so that the user can more easily use the cosmetic solution.

More particularly, the cosmetic solution provided through the discharge part 23 is moved up to the upper portion of the dish-type panel 57 through the space part 57*b* and the micro-discharge holes 57*a*. Thereafter, the user can make up using the cosmetic solution moved up to the upper portion of the disk-type panel 57.

In this case, since the disk-type panel 57 is coupled by the sealing cover, the disk-type panel 57 is maintained in the fixing state while continuously discharging the cosmetic solution through the micro-discharge hole 57*a*.

When the pressure applied to the push button 47 is released after the user finishes the use of the compact container 100, the push button 47 is moved to the original position by the action of the elastic unit.

In this case, the pressure applied to the flange part 61 of the discharge port opening/closing unit 51 is released by the step part 75 of the push button 47, and the discharge port opening/closing unit 51 is returned to the original position by the resilience of the elastic unit 37 located between the first cylinder 33 and the second cylinder 35 to close the discharge port 23.

In this process, the valve module 77 is moved in the direction of the storage space 39 due to the pressure difference, which is the generally known physical law. As the valve module 77 is moved, the valve body 81 of the valve module 77 opens a storage space communication hole 73 to communicate the first storage space 10 with the second storage space 39. The contents stored in the first storage space 10 is moved into the second storage space 33 and filled in the second storage space 39, and the difference in pressure between the first and second storage spaces 10 and 39 is reduced so that the valve module 77 stops the storage space communication hole 79.

Further, the content compressing unit 41 is moved to a lower portion of the first storage space 10 as the height of the contents received in the first storage space 10 is lowered. Accordingly, the compact container 100 according to the present invention selectively discharges a required amount of contents by using the push button 47, thereby maximizing the makeup effect.

The invention claimed is:

1. A compact container having a function of uniformly discharging a cosmetic solution, the compact container comprising:

a container body (11) having a first storage space to store contents therein;

a fixing structure (15) securely mounted in the container body to define the first storage space and having a structure hole;

a first case (25) mounted on the container body to cover the fixing structure and having a discharge port to discharge the contents from the container body;

a disk-type panel (57) mounted on the first case and having a plurality of micro-holes to guide the contents provided through the discharge port such that the contents are discharged upward in a diffused form;

a piston module (43) located in the structure hole to move between upper and lower portions of the structure hole and to open/close the discharge port;

a push button (47) interposed between the fixing structure and a protective case and performing a push operation to move the piston module between the upper and lower portions of the structure hole;

a content compressing unit (41) mounted on an inner wall of the fixing structure to move the contents, which are stored in the first storage space, into the structure hole by the operation of the push button; and a valve module (77) to open/close the fixing structure in the first storage space by an operation of the content compressing unit and to communicate the structure hole with the first storage space.

2. The compact container of claim 1, wherein the push button (47) and the piston module (43) move in directions perpendicular to each other.

3. The compact container of claim 2, wherein the push button (47) comprises:

a first pressing unit (73) including a pressing protrusion (73*a*), and a first horizontal panel (73*b*) extending from both sides of the pressing protrusion, wherein the first horizontal panel is formed therein with an insertion hole (73*c*) having a semi-circular shape and hinge parts (73*d*) formed at both sides of the first horizontal panel (73*b*); and a second pressing unit (75) fitted into the insertion hole (73*c*) of the first pressing unit (73), and including a support protrusion (75*a*), and a second horizontal panel (75*b*) extending from both sides of the support protrusion, wherein the second pressing unit (75) is coupled to the first horizontal panel through a hinge (75*c*), and the second horizontal panel (75*b*) is formed therein with a hole (75*d*) having a semi-circular shape.

4. The compact container of claim 2, wherein the piston module (43) comprises:

a discharge port opening/closing unit (51) to open/close the discharge port through an opening/closing unit through hole formed in the push button;

a sealing unit (53) moving up and down corresponding to up and down movement operations of the discharge port opening/closing unit; and a support member (55) passing through the sealing unit and controlling discharge of the contents by making contact with or separating from an end of the sealing unit.

5. The compact container of claim 1, further comprising a sealing cover additionally mounted on the disk-type panel, having a ring shape, and serving as a fixing unit.

6. The compact container of claim 1, further comprising a space part (57*b*) interposed between the first case (25) and the disk-type panel (57), wherein the cosmetic solution provided through the discharge port (23) passes through the space part (57*b*).

7. The compact container of claim 1, wherein the disk-type panel (57) is located on the piston module (43).

8. The compact container of claim 1, wherein the disk-type panel (57) includes metal or synthetic resin.

9. The compact container of claim 1, wherein the push button (47) comprises:

a first pressing unit (73) including a pressing protrusion (73*a*), and a first horizontal panel (73*b*) extending from both sides of the pressing protrusion, wherein the first horizontal panel is formed therein with an insertion hole (73*c*) having a semi-circular shape and hinge parts (73*d*) formed at both sides of the first horizontal panel (73*b*); and a second pressing unit (75) fitted into the insertion hole (73*c*) of the first pressing unit (73), and including a support protrusion (75*a*), and a second horizontal panel (75*b*) extending from both sides of the support protrusion, wherein the second pressing unit (75) is coupled to the first horizontal panel through a hinge (75*c*), and the second horizontal panel (75*b*) is formed therein with a hole (75*d*) having a semi-circular shape.

10. The compact container of claim 1, wherein the piston module (43) comprises:

a discharge port opening/closing unit (51) to open/close the discharge port through an opening/closing unit through hole formed in the push button;

a sealing unit (53) moving up and down corresponding to up and down movement operations of the discharge port opening/closing unit; and a support member (55) passing through the sealing unit and controlling discharge of the contents by making contact with or separating from an end of the sealing unit.

* * * * *